United States Patent [19]

Crutchfield

[11] Patent Number: 4,647,002

[45] Date of Patent: Mar. 3, 1987

[54] RAM BLOWOUT PREVENTER APPARATUS

[75] Inventor: Mark K. Crutchfield, Kingwood, Tex.

[73] Assignee: Hydril Company, Los Angeles, Calif.

[21] Appl. No.: 783,252

[22] Filed: Sep. 30, 1985

Related U.S. Application Data

[63] Continuation of Ser. No. 535,303, Sep. 23, 1983, abandoned.

[51] Int. Cl.[4] ..... E21B 33/06

[52] U.S. Cl. ..... 251/1.3; 277/30; 277/192

[58] Field of Search ..... 251/1.3; 277/30, 31, 277/166, 192

[56] References Cited

U.S. PATENT DOCUMENTS

| | | | |
|---|---|---|---|
| 3,102,709 | 9/1963 | Allen | 251/1 A |
| 3,434,729 | 3/1969 | Shaffer et al. | 251/1 A |
| 3,946,806 | 3/1976 | Meynier, III | 251/1 A |
| 4,323,256 | 4/1982 | Miyagishima et al. | 251/1 A |
| 4,332,367 | 6/1982 | Nelson | 251/1 A |
| 4,347,898 | 9/1982 | Jones | 251/1 A |
| 4,398,729 | 8/1983 | Bishop et al. | 251/1 A |
| 4,416,441 | 11/1983 | Van Winkle | 251/1.3 |

*Primary Examiner*—Martin P. Schwadron
*Assistant Examiner*—Sheri M. Novack
*Attorney, Agent, or Firm*—Dodge, Bush & Moseley

[57] ABSTRACT

A top seal, ram assembly, blowout preventer, and housing for a blowout preventer are disclosed according to the invention in which outer anti-extrusion plates are provided at the ends of the top seal which are adapted for bearing against a surface of the blowout preventer housing. The housing of the blowout preventer is provided with a horizontal bore having a generally rectangular cross-section with thickened vertical wall sections in the proximity of the vertical bore through the housing. The thickened wall sections are adapted to cooperate with the outer anti-extrusion plates of the top seal in order to support the pressure created in the packer and the top seal when the rams are closed.

22 Claims, 8 Drawing Figures

FIG. 1
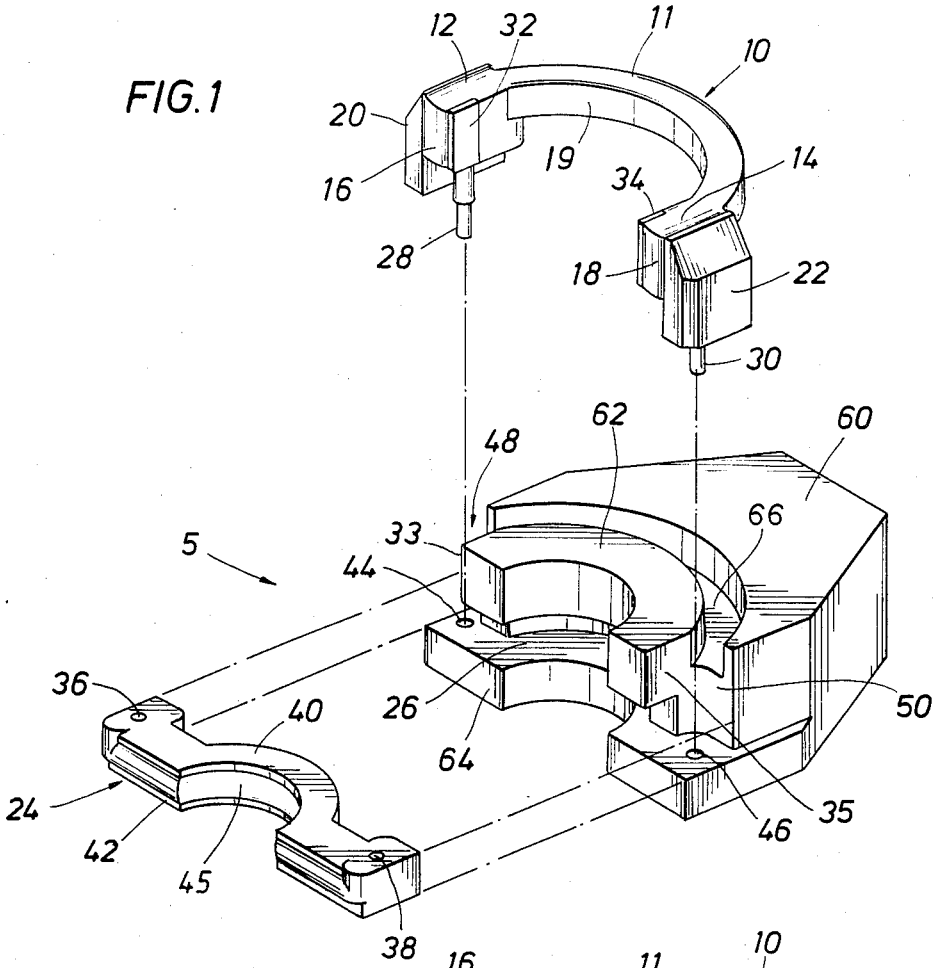
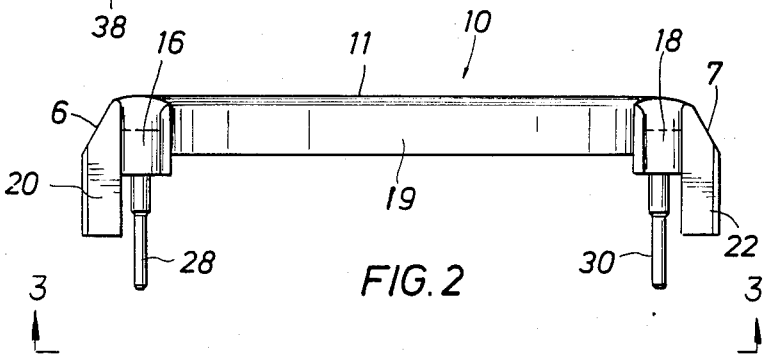
FIG. 2
FIG. 4
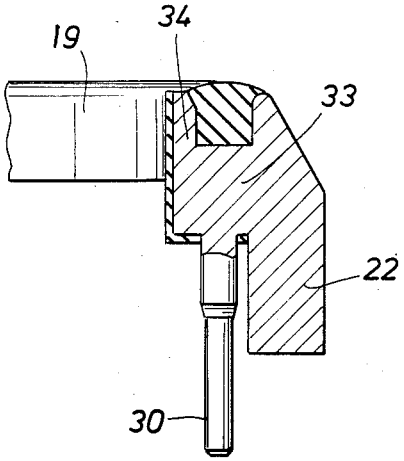
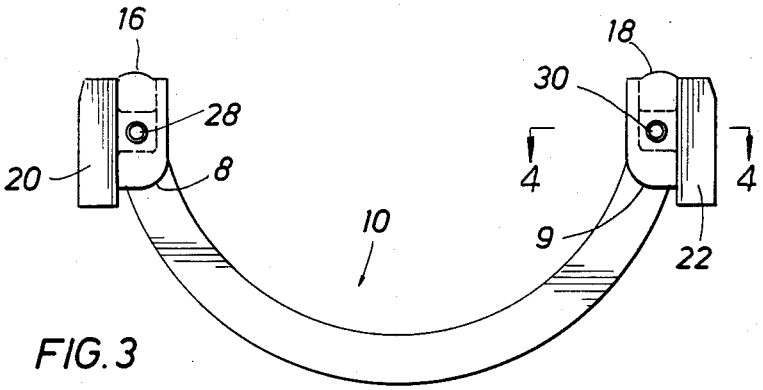
FIG. 3

RAM BLOWOUT PREVENTER APPARATUS

This application is a continuation of application Ser. No. 535,303, filed Sept., 23, 1983 now abandoned.

BACKGROUND OF THE INVENTION

1. Field of the Invention

This invention relates to blowout preventers for use in oil and gas well operations. More particularly, the invention relates to a ram blowout preventer. Still more particularly, the invention relates to a ram blowout preventer which is designed for a given pressure rating and vertical bore size to be as compact and light as reasonably possible.

2. Description of the Prior Art

Ram blowout preventers for use in the oil and gas industry are generally well known. Conventional ram blowout preventers have two or more ram assemblies for fitting about a pipe within the bore of the blowout preventer body to close off the annulus between the pipe and bore or for abutting with one another to close off an open bore. In a ram blowout preventer of this type, the ram assemblies are adapted in their closed position to form a continuous seal with one another across their front faces and across their tops. Sealing across the tops between the ram assemblies and the upper surface of the horizontal bore of the body is accomplished by means of a top seal. The packer in the face of the ram assembly in cooperation with the top seal forms a continuous sealing surface which is effective in sealing off well bore pressure after the ram assemblies are closed.

U.S. Pat. No. 3,102,709 issued in the name of Herbert Allen describes one prior art ram sealing assembly. In that assembly a top seal is provided which extends across the top of the ram member and sealing material is provided along the side of the assembly by the packer and the top seal. Such a ram assembly in cooperation with its horizontal bore seals along the sides of the horizontal ram blowout preventer bore requiring close tolerance machining of a large part of the ram bore. Such machining of a blowout preventer body may raise the manufacturing cost considerably.

Another ram blowout preventer structure is disclosed in U.S. Pat. No. 3,434,729 issued in the name of D.U. Shafer, et al. Illustrated in that patent is a ram assembly which provides for side support of the sealing elements within the ram assembly itself resulting in extra width of the ram. Such extra width of the ram consequently results in wider ram bores and correspondingly large ram blowout preventer bodies.

SUMMARY OF THE INVENTION

It is therefore an object of this invention to provide a ram blowout preventer for a given vertical bore diameter and pressure rating that is more narrow than previous ram blowout preventers and is therefore lighter and more compact.

It is a further object of this invention to provide a ram assembly and blowout preventer housing which requires less machining than prior assemblies and housings.

It is a further object of the invention to provide a ram blowout preventer in which the housing is designed in cooperation with the top seal of the ram assembly to bear the containing load of the horizontal anti-extrusion elements of the assembly and not the ram block itself.

It is a further object of the invention to provide metallic inserts in the top seal of the ram assembly which rest against machined thickened vertical wall sections in the vicinity of the vertical bore of the housing thereby providing support and extrusion resistance to the elastomeric portions of the packer and top seal of the ram assembly.

It is a further object of the invention to use the strength of the blowout preventer body to contain the rubber ram packers by having the thin metallic sections outboard of the rubber packers which ride against machined pads in the blowout preventer ram cavity with the result that a smaller ram and blowout preventer is required to be provided for a given vertical bore and pressure rating size.

The objects mentioned above as well as other advantages and features of the invention are provided in a novel top seal and ram blowout preventer body horizontal cavity. According to the invention, the seal comprises an elastomeric sealing member having a top surface which is adapted for sealing between the ram member of a ram assembly and the blowout preventer housing. The sealing member has first and second ends each with a terminating sealing surface adapted for sealing with a like terminating surface of a cooperating ram assembly. Each of the ends of the top seal have secured thereto an outer anti-extrusion plate adapted for bearing against a surface of the blowout preventer housing. The seal further comprises a pair of downwardly extending rods which extend through holes in the outer ends of the packer inserted into a lateral front slot of the ram member for connecting the top seal and packer to the ram member. The seal further comprises a pair of inner anti-extrusion plates secured to the ends of the elastomeric sealing member where each of the inner anti-extrusion plates are adapted for bearing against a surface of the ram member. Preferably, the outer anti-extrusion plate and the inner anti-extrusion plate are secured to each other by a connecting member to which the downwardly extending rods are also secured. Preferably the connecting member is embedded within the elastomeric material of the top seal. Preferably the inner and outer anti-extrusion plate, connecting member and downwardly extending rod form a unitary integral member.

According to the invention, the outer anti-extrusion plates extend downwardly from the ends of the elastomeric sealing member and the downwardly extending rods extend further downwardly than the outer anti-extrusion plates. The outer anti-extrusion plates extend sufficiently downwardly from the ends of the elastomeric sealing member to shield the outer side of the ends of the sealing member and to shield the exposed outer sides of the packer inserted in the horizontal slot of the front face of the ram member. The inner anti-extrusion plate extends downwardly from each of the ends of the elastomeric sealing member along the inner side adjacent the terminating sealing surface.

According to the invention, the horizontal bore of the body of the blowout preventer housing has a generally rectangular cross-section with thickened vertical wall sections in the vicinity of the vertical bore. The thickened wall sections cooperate with the outer anti-extrusion plates of the top seal to support the pressure created in the packer and the top seal when the ram assemblies are closed. The thickened wall sections of the horizontal bore of the blowout preventer housing are formed by the vertical walls of the bore extending inwardly at the center of the vertical bore through the housing.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown of which:

FIG. 1 is an exploded view of the ram assembly member according to the invention illustrating the ram member, the packer adapted to fit within a horizontal slot of the ram member and the top seal member with outboard anti-extrusion plates secured thereto;

FIG. 2 is a front view of the top seal member;

FIG. 3 is a bottom view of the top seal member;

FIG. 4 is a cross-section through section lines 4—4 of FIG. 3 illustrating the integral outer and inner anti-extrusion plates as well as the connecting member and downwardly extending rod;

DESCRIPTION OF THE INVENTION

Figure 5:
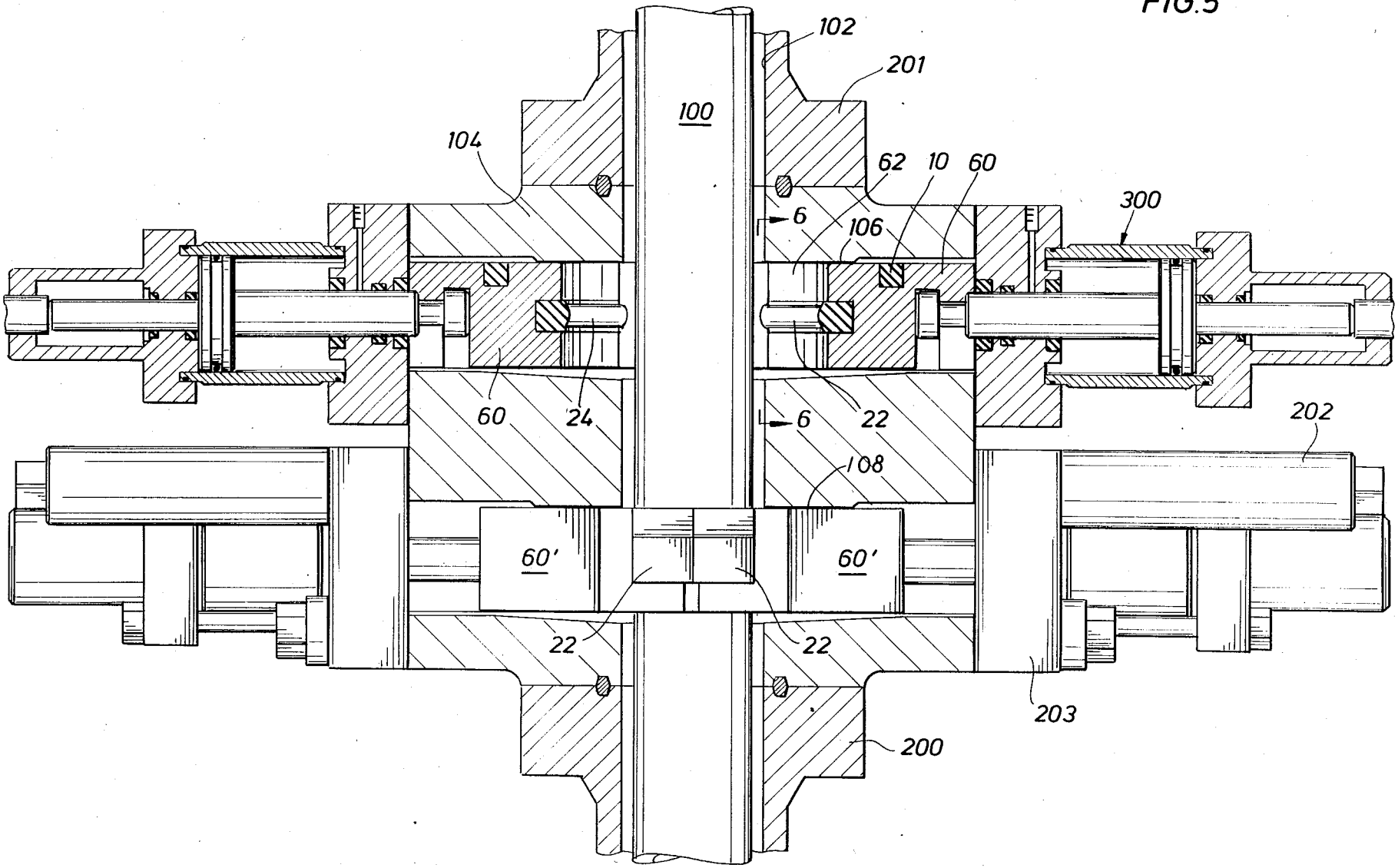
FIG. 5 is a side elevational view of the blowout preventer, according to the invention, partly in section in which the ram assembly member is illustrated and further illustrating two rams in a common housing in which one set of the ram members is closed about a tubular member in the vertical bore of the housing and the other set of ram assembly members is open.

FIG. 1 shows in an exploded view, the ram assembly 5, according to the invention. The ram assembly 5 includes a ram member 60, a top seal or elastomeric sealing member 10 disposed in a slot 66 in the top of the ram block and a packer 24 disposed in a lateral slot 26 in the front face of the ram member 60. The packer 24 and the top ram block 62 and bottom ram block 64 are illustrated as being adapted for sealing about a single tubular member, but as will be well appreciated to those skilled in the art of ram blowout preventers, a blind ram where no semi-circular opening in the faces of the top ram block, bottom ram block and packer is provided is within the scope of this invention. Likewise, an offset semi-circular opening in the packer and ram blocks or two offset semi-circular openings in the top and bottom ram blocks and packer may be provided as is well known in the art of ram blowout preventers.

According to the invention, a top seal 10 is provided in which a resilient or elastomeric material is provided having a top surface 11. The top seal 10 includes a first end 12 and a second end 14 in which a terminating sealing surface 16 and terminating sealing surface 18 are provided at its ends. As illustrated, the terminating sealing surfaces 16 and 18 extend vertically downward at the ends 12 and 14 of the top seal but could be designed to extend downwardly at an angle from the vertical.

According to the invention, "outboard" or outer anti-extrusion plates 20 and 22 are attached at the outer sides of the first end 12 and second end 14 of the top seal 10. Likewise, inner anti-extrusion plates 32 and 34 are provided inwardly at the first end 12 and the second end 14 of the top seal 10. In addition, downwardly extending rods 28 and 30 extend from the first end 12 and the second end 14 of the top seal 10.

As the exploded view of FIG. 1 illustrates, the rods 28 and 30 are advantageously provided to pass through the holes 36 and 38 of packer 24 when the packer 24 is inserted into the lateral slot 26 in the front face of the ram member 60. The rods 28 and 30 are long enough to pass completely through the holes 36 and 38 of packer 24 and into holes 44 and 46 in the ram block 60, thereby securing the packer 24 and top seal 10 to the ram member 60 with the packer in the slot 26 and the top seal 10 in the top slot 66 of the ram member 60.

The inner anti-extrusion plates 32 and 34 are adapted to bear against surfaces 33 (not visible) and 35 of the top ram block 62 as will be explained below. When the ram member is forced inwardly against a tubular member in the vertical bore of the ram blowout preventer housing and the ram assembly 5 cooperatively bears against a like ram member from the other side in the lateral bore of the blowout preventer housing, the packer 24 and the terminating sealing surfaces 16 and 18 cooperatively seal with like members from the opposing ram assembly. As they are urged strongly against one another, the ram member 60 urges against the rear of the packer 24 and elastomeric sealing material 45 of the packer 24 is urged outwardly to meet the elastomeric material of the opposing packer. The metallic plates 40 and 42 embedded to the top and bottom of packer 24 act to prevent rubber from extruding vertically past the plates. The terminating sealing surfaces 16 and 18 likewise are forced against like terminating sealing surfaces of the opposing ram assembly and as they are urged against one another, the elastomeric material of semi-circular member 19 is urged rearwardly into the slot 66 and feeds upwardly forming a top seal about the upper surface of the horizontal bore of the blowout preventer housing.

The top seal member is under extremely high pressure created in it caused by the urging of the ram member against the other terminating sealing surfaces of the opposing top seal. The high pressure in the top seal is maintained inwardly by the inner anti-extrusion plates 32 bearing against the surfaces 33 (not visible) and 35 of the top ram block 62 and is contained outwardly by the outer anti-extrusion plates 20 and 22. Advantageously, as will be described below, the outer anti-extrusion plates 20 and 22 bear against thickened wall sections of the horizontal bore in the vicinity of the vertical bore.

As illustrated in FIG. 1, the first and second ends 12 and 14 fit within cutaway portions 48 (partially visible) and 50 of the top ram block 62. In other words, a portion is cutaway from the ends of the top ram block 62 leaving voids 48 and 50 in which the first and second ends 12 and 14 of the top seal 10 may fit. As explained above, the inner anti-extrusion plates 32 and 34 bear against surfaces 33 and 35 on the outboard ends of the top ram block 62 and serve to prevent inward extrusion of the resilient material in the top seal during closure of mating ram members 60.

FIG. 2 shows a front view of the top seal 10. In this view, the rods 28 and 30 are shown extending downwardly beyond the outboard anti-extrusion plates 20 and 22. Also illustrated are the angled cutoff portions 6 and 7 of anti-extrusion plates 20 and 22 which cooperate with the shape of the horizontal bore of the housing of the blowout preventer so as not to rub or scrape the housing corner cross-section during travel into or out of the horizontal bore. Also illustrated are the inner and outer anti-extrusion plates 32, the top surface 11 of the top seal 10 and the terminating sealing surfaces 16 and 18 of the top seal.

FIG. 3 shows a bottom view looking upward along the lines 3—3 of FIG. 2 of the top seal 10. The surfaces 16 and 18 are illustrated along with the rods 28 and 30 from the bottom view. The bottom view shows the curved portions 8 and 9 of the bottom of the first and second ends of the top seal. The curved portions 8 and 9 fit within the corners of the voids 48 and 50 in the top ram block 62.

FIG. 4 illustrates in a cross-section through lines 4—4 of FIG. 3, the construction of the outer anti-extrusion plate 22, inner anti-extrusion plate 34 and rod 30. These elements are formed of a single unitary member with a connecting piece 33 interconnecting the rod 30, inner anti-extrusion plate 34 and outer anti-extrusion plate 22. As illustrated in FIGS. 1 through 4, a unitary member comprising an inner and an outer anti-extrusion plate, a rod and a connecting member is embedded within the end 12 of the top seal 10. Another unitary member is embedded within the end 14 of top seal 10.

FIG. 5 shows a cross-section of a preferred embodiment of the ram blowout preventer according to the invention. A blowout preventer housing body 104 is illustrated having a vertical bore 102 in which a tubular member 100 is shown inserted. Horizontal bores 106 and 108 are illustrated in a dual ram blowout preventer configuration. In the horizontal bore 106 shown in cross-section are identical ram blocks 60 each having a top seal 10 and packer 24 constructed according to that illustrated in FIGS. 1 through 4. As illustrated, the ram blocks 60 are in the open position. When the ram blocks are closed the top seal 10 acts to seal about the upper surface of the horizontal bore 106 while the packer 24 when urged inwardly seals about the tubular member 100 in coordination with the terminating end surfaces of the top seal as illustrated in FIG. 1.

The ram blocks 60′ are shown in elevation in the second horizontal bore 108 as they are closed about the tubular member 100. The means for inwardly ramming the ram blocks 60 and 60′ are illustrated in cross-section for the top horizontal bore and in elevation for the lower horizontal bore. The ram closing mechanism 300 illustrated in schematic fashion is similar to those provided in prior art ram blowout preventers. The nut 202 for securing bonnet 203 to housing 104 is the subject of a co-pending patent application which is assigned to the assigneee of this application. In a like fashion, the means for connecting the blowout preventer housing 104 to other well equipment 200 and 201 below or above the ram blowout preventer housing is similar to prior ram blowout preventers.

Figure 6:
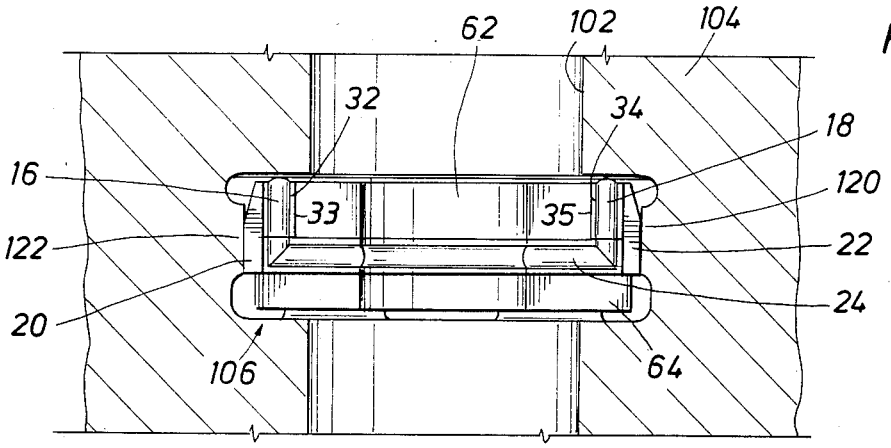
FIG. 6 is a view of the face of the ram assembly member and the horizontal bore of the blowout preventer housing taken along a section 6—6 of FIG. 5.

FIG. 6 is a side view taken along section 6—6 of the housing 104 and the ram block 60. In FIG. 6, the vertical bore 102 is seen passing through housing 104. The packer 24 is illustrated between the upper ram block 62 and the lower ram block 64. The horizontal bore 106 is seen to be a generally rectangular cross-section in the vicinity of the vertical bore of the blowout preventer housing 104 and includes thickened vertical wall sections 120 and 122 along its vertical sides. The terminating sealing surfaces 16 and 18 of the top seal are illustrated as cooperating with the packer 24. The outer anti-extrusion plates 20 and 22 are illustrated as bearing against the thickened vertical wall sections 122 and 120 of the lateral bore 106. Likewise, the inner anti-extrusion plates 32 and 34 are shown bearing against the outer end surfaces 33 and 35 of top ram block 62. The thickened wall sections 122 and 120 of the housing 104 cooperate with the outer anti-extrusion plates 20 and 22 of the top seal in order to support the pressure created in the packer 24 and the top seal 10 when the rams are closed. The outer anti-extrusion plates 20 and 22, in that regard, extend downwardly beyond the terminating sealing surfaces 16 and 18 of the top seal 10 and serve as an outer anti-extrusion plate against the outer ends of the packer 24.

Figure 7:
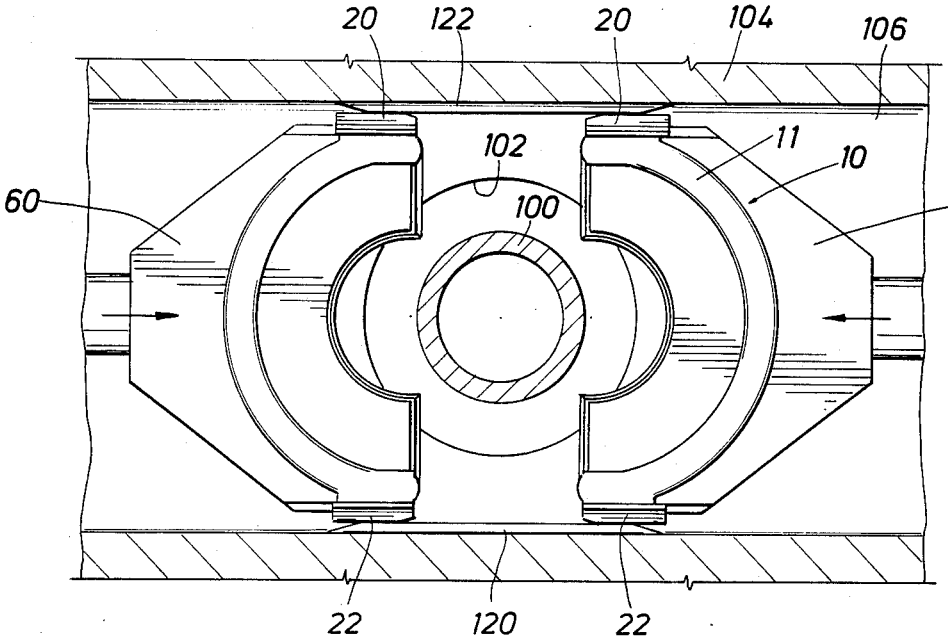
FIG. 7 is a top view of the ram assembly members as they are closing about a tubular member in the vertical bore of the housing and further illustrating thickened vertical wall sections in the housing which cooperate with outboard anti-extrusion plates secured to the top seals of the ram assembly members.
Figure 8:
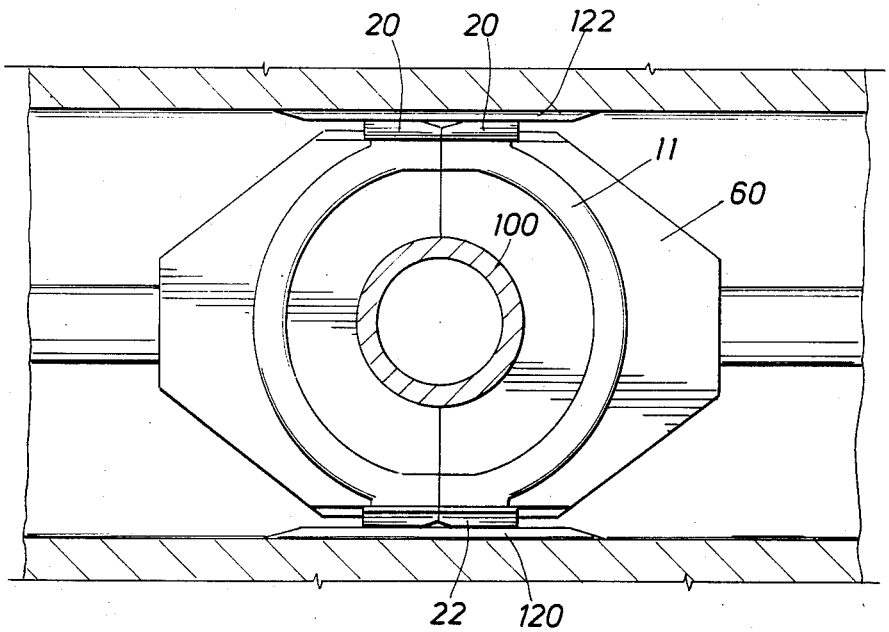
FIG. 8 is a top view of the ram assembly members as they are fully closed and sealing about a tubular member in the blowout preventer housing.

FIGS. 7 and 8 are top views looking down on the ram assembly 60, where FIG. 7 illustrates the ram assemblies during closing and FIG. 8 illustrates the ram assemblies in a closed position. The thickened vertical wall sections 120 and 122 of the horizontal bore 106 can be seen to cooperate with the anti-extrusion plates 20 and 22 of the ram assembly to prevent the elastomeric material of the top seal 10 and packer 24 from extruding outwardly from the ends of the rams. Only the thickened wall sections 122 and 120 need be machined along the vertical sides of the vertical bore 106 in order that the outer anti-extrusion plates 20 and 22 may provide a sliding fit therein. The strength of the blowout preventer body contains the resilient material of the ram packers and the first and second ends of the top seal in the blowout preventer ram cavity itself with the result that a smaller ram and blowout preventer is required to be provided for a given vertical bore and pressure rating size.

Various modifications and alterations in the described structures will be apparent to those skilled in the art of the foregoing description which does not depart from the spirit of the invention. For this reason, these changes are desired to be included in the appended claims. The appended claims recite the only limitation to the present invention and the descriptive manner which is employed for setting forth the embodiments and is to be interpreted as illustrative and not limitative.

What is claimed is:

1. A seal adapted for use with a ram member of a ram blowout preventer, the preventer having a housing with a vertical bore and a horizontal bore including an internal surface, the preventer housing having thickened vertical wall sections approximate an intersection of the horizontal bore and the vertical bore, said seal comprising, a monolithic elastomeric sealing member having a top surface adapted for sealing between the ram member of a ram assembly and the blowout preventer housing and having first and second ends each with a terminating sealing surface adapted for sealing with a terminating sealing surface of a cooperating ram assembly, each of the ends having secured thereto an outer anti-extrusion plate adapted for slidably bearing directly against the internal surface of the horizontal bore of the blowout preventer housing wherein the outer anti-extrusion plates extend sufficiently downwardly from the ends of the elastomeric sealing member to shield the outer side of the ends of the sealing member and to shield the exposed outer sides of a packer inserted in a lateral slot in a front face of the ram member.

2. The seal of claim 1 further comprising,
means for connecting the sealing member to a packer inserted in a lateral slot in the front face of the ram member.

3. The seal of claim 2 wherein the connecting means is a pair of downwardly extending rods, one rod embedded in the first end of the sealing member, the other rod embedded in the second end of the sealing member.

4. The seal of claim 3 further comprising a pair of inner anti-extrusion plates secured to the ends of the elastomeric sealing member, each of the inner anti-extrusion plates adapted for bearing against a surface of the ram member.

5. The seal of claim 4 wherein
the outer anti-extrusion plate and the inner anti-extrusion plate at an end of the seal are secured by a connecting member and the rod extending downwardly is secured to the connecting member and wherein
the connecting member is embedded within the elastomeric material of the sealing member.

6. The seal of claim 4 wherein the outer anti-extrusion plate, inner anti-extrusion plate, connecting member and downwardly extending rod are a unitary member.

7. The seal of claim 1 wherein the terminating sealing surfaces of the first and second ends of the sealing member are oriented vertically with respect to the top surface.

8. The seal of claim 4 wherein
an inner anti-extrusion plate extends downwardly from each of the ends of the elastomeric sealing member along the inner side adjacent the terminating sealing surface.

9. A ram assembly adapted for use with a ram blowout preventer, the preventer having thickened vertical wall sections approximate an intersection of a horizontal bore and a vertical bore, said ram assembly comprising,
a ram member adapted for movement through the horizontal bore of the ram blowout preventer,
the ram member having a front face with a lateral slot,
an upper surface of the ram member having a slot provided therein,
a packer disposed in the lateral slot and having two vertical holes, one each in the outer ends of the packer,
a monolithic elastomeric sealing member disposed in the slot of the upper surface of the ram member and having a top surface adapted for sealing between the ram member and a horizontal bore surface of the ram blowout preventer and having first and second ends each with a terminating sealing surface adapted for sealing with a terminating sealing surface of a cooperating ram,
each of the ends of the elastomeric sealing member having secured thereto an outer anti-extrusion plate adapted for slidably bearing directly against the thickened vertical wall sections of the ram blowout preventer, and
each of the ends of the elastomeric sealing member having secured thereto a downwardly extending rod, one of the rods extending into one of the vertical holes of the packer, the other of the rods extending into the other of the vertical holes of the packer.

10. The ram assembly of claim 9 wherein the rods extend downwardly from the sealing member are embedded in the elastomeric material of the sealing member.

11. The ram assembly of claim 9 further comprising a pair of inner anti-extrusion plates secured to the ends of the elastomeric sealing member, each of the inner anti-extrusion plates adapted for bearing against a surface of the ram.

12. The ram assembly of claim 11 wherein
the outer anti-extrusion plate and the inner anti-extrusion plate at an end of the top seal are secured by a connecting member and the rod extending downwardly is secured to the connecting member, and wherein
the connecting member is embedded within the elastomeric material of the sealing member.

13. The ram assembly of claim 12 wherein the outer anti-extrusion plate, inner anti-extrusion plate, connecting member and downwardly extending rod are integral parts.

14. The ram assembly of claim 9 wherein the terminating sealing surface of the first and second ends of the sealing member is vertically disposed with respect to the top surface.

15. The ram assembly of claim 11 wherein the outer anti-extrusion plates extend downwardly from the ends of the elastomeric sealing member and the downwardly extending rods extend further downwardly than the outer anti-extrusion plates, its rods adapted to be inserted through holes provided in the packer and the ram for securing the top seal and packer to the ram.

16. The ram assembly of claim 10 wherein the outer anti-extrusion plates extend sufficiently downwardly from the ends of the elastomeric sealing member to cover the outer side of the ends of the sealing member and to cover the exposed outer sides of the packer inserted in the horizontal slot in the front face of the ram.

17. The ram assembly of claim 12 wherein
an inner anti-extrusion plate extends downwardly from each of the ends of the elastomeric sealing member along the inner side adjacent the terminating sealing surface.

18. A ram blowout preventer comprising,
a body,
a vertical bore through the body adapted for the passage of tubing or other objects,
a horizontal bore through the body intersecting the vertical bore through the body, two ram assemblies disposed in the horizontal bore in opposite sides of the body, the ram assemblies adapted for controlled lateral movement to and from the vertical bore,
each ram assembly having a ram member with a front face with a lateral slot,
the upper surface of each ram member having a slot disposed therein,
a packer disposed in the lateral slot of each ram member,
an elastomeric sealing member disposed in the slot of the upper surface of each ram member, each sealing member having a top surface adapted for sealing between the ram member and a horizontal bore surface of the body and having two terminating sealing surfaces adapted for sealing with complementary sealing surfaces of the other ram assembly,
each of the ends of the elastomeric sealing members having secured thereto a slidable outer anti-extrusion plate, the horizontal bore through the body having a generally rectangular cross-section with thickened vertical wall sections in the vicinity of the vertical bore, said thickened wall sections cooperating with said sliding outer anti-extrusion plates of said elastomeric sealing member to support the pressure created in the packer and the elastomeric sealing member when the ram assemblies are closed.

19. The ram blowout preventer of claim 18 wherein the thickened wall sections of the horizontal bore are formed by the vertical walls of the bore extending inwardly at the center of the vertical bore through the body.

20. A blowout preventer housing adapted to receive two ram assemblies where each ram member assembly has a ram member having a front face with a lateral slot, the upper surface of each ram having a slot disposed therein, each ram member having a packer disposed in the lateral slot, each ram member having an elastomeric sealing member disposed in the slot of the upper surface of each ram, each sealing member having a top surface adapted for sealing between the ram member and the top surface adapted for sealing between the ram member and the top horizontal bore surface of the body and having two terminating sealing surfaces adapted for sealing with complementary terminating sealing surfaces of the other ram, each of the ends of the elastomeric sealing members having secured thereto an outer anti-extrusion plate, the housing comprising, a body, a vertical bore through the body adapted for the passage of tubing or other objects, a horizontal bore through the body which intersects the vertical bore, the horizontal bore adapted to receive said two ram assemblies, one each in opposite sides of the body, the horiztonal bore having a generally rectangular cross-section with thickened vertical wall sections approximate the vertical bore, said thickened wall sections adapted to cooperate with the sliding outer anti-extrusion plates of the elastomeric sealing member to support partially the pressure created in the packer and the elastomeric sealing member when the ram assemblies are closed.

21. A seal adapted for use with a ram member of a ram blowout preventer, the preventer having a housing with a vertical bore and a horizontal bore including an internal surface, the preventer housing having thickened vertical wall sectons approximate intersection of the horizontal bore and the vertical bore, said seal comprising, a monolithic elastomeric sealing member having a top surface adapted for sealing between the ram member of a ram assembly and the blowout preventer housing and having first and second ends each with a terminating sealing surface adapted for sealing with a terminating sealing surface of a cooperating ram assembly, each of the ends having secured thereto an outer anti-extrusion plate adapted for slidably bearing directly against the internal surface of the blowout preventer housing, said plates interposed between said elastomeric ends and the housing so that said plates restrict extrusion of said ends of said elastomeric sealing member by using the strength of the housing, a pair of downwardly extending rods, one rod embedded in the first end of the sealing member, the other rod embedded in the second end of the sealing member, said rods adapted for connecting the sealing member to a packer inserted in a lateral slot in a front face of the ram member, and wherein said outer anti-extrusion plates extend downwardly fromthe ends of the elastomeric sealing member and the downwardly extending rods extend further downwardly than the outer anti-extrusion plates, the rods adapted to be inserted through holes provided in the packer and the ram member for securing the sealing member and packer to the ram member.

22. A seal adapted for use with a ram member of a ram blowout preventer, the preventer having a housing with a vertical bore and a horizontal bore including an internal surface, the preventer housing having thickened vertical wall sections approximate an intersection of the horizontal bore and the vertical bore, said seal comprising, a monolithic elastomeric sealing member having a top surface adapted for sealing between the ram member of a ram assembly and the blowout preventer housing and having first and second ends each with a terminating sealing surface adapted for sealing with a terminating sealing surface of a cooperating ram assembly, each of the ends having secured thereto an outer anti-extrusion plate adapted for slidably bearing directly against the internal surface of the blowout preventer housing, means for connecting the sealing member to a packer inserted in a lateral slot in a front face of the ram member, and wherein said outer anti-extrusion plates extend sufficiently downwardly from the ends of the elastomeric sealing member to shield the outer side of the ends of the sealing member and to shield the exposed outer sides of the packer.

* * * * *